US005380004A

United States Patent [19]

Teramoto et al.

[11] Patent Number: 5,380,004

[45] Date of Patent: Jan. 10, 1995

[54] IRON-TYPE GOLF CLUB SET

[75] Inventors: Mitsutake Teramoto; Takaharu Okumoto; Hideyo Asabuki, all of Hiratsuka, Japan

[73] Assignee: The Yokohama Rubber Co., Ltd., Tokyo, Japan

[21] Appl. No.: 62,228

[22] Filed: May 18, 1993

[30] Foreign Application Priority Data

May 28, 1992 [JP] Japan ..... 4-035888[U]
May 28, 1992 [JP] Japan ..... 4-035897[U]

[51] Int. Cl.[6] ..... A63B 53/00

[52] U.S. Cl. ..... 273/77 A; 273/78; 273/167 J

[58] Field of Search ..... 273/77 A, 167-175, 273/77 R, 78

[56] References Cited

U.S. PATENT DOCUMENTS

| | | | |
|---|---|---|---|
| 3,963,236 | 6/1976 | Mann | 273/77 A |
| 4,582,321 | 4/1986 | Yoneyama | 273/78 |
| 4,618,149 | 10/1986 | Makel | 273/77 A |
| 4,645,207 | 2/1987 | Teramoto et al. | 273/77 A |
| 4,854,580 | 8/1989 | Kobayashi | 273/77 A |
| 4,884,812 | 12/1989 | Nagasaki et al. | 273/169 |
| 5,009,425 | 4/1991 | Okumoto et al. | 273/169 |
| 5,228,688 | 7/1993 | Davis | 273/77 A |

FOREIGN PATENT DOCUMENTS 63-102463 7/1988 Japan .

*Primary Examiner*—Vincent Millin
*Assistant Examiner*—Steven B. Wong
*Attorney, Agent, or Firm*—Finnegan, Henderson, Farabow, Garrett & Dunner

[57] ABSTRACT

An iron-type golf club set includes three club groups; a long iron-type club group comprising a plurality of long iron-type clubs having lower club numbers, a middle iron-type club group including a plurality of middle iron-type clubs having medium club numbers, and a short iron club group including a plurality of short iron-type clubs having higher club numbers. The long iron-type clubs of the long iron-type club group each includes a club head which contains a sole made of a metal material and a shell having a ball-hitting face and a core which is made of a foaming material and enclosed in the shell, and the shell is made of a fiber-reinforced material. The middle iron-type clubs of the middle iron-type club group each includes a club head having a sole and an external periphery each made of a metal material and at least a ball-hitting face made of a fiber-reinforced resin. The short iron-type clubs of the short iron-type club group each includes a club head made of a metal material.

8 Claims, 4 Drawing Sheets

IRON-TYPE GOLF CLUB SET

BACKGROUND OF THE INVENTION

The present invention relates to an iron-type golf club set including a plurality of iron-type golf clubs and, more specifically, to an iron-type golf club set which is capable of improving the function of a long iron club group and of ensuring continuity in shot feeling between the long iron club group and a short iron club group.

In general, such an iron-type golf club set includes a combination of a series of iron-type golf clubs numbered 1 through 9 and a PW (pitching wedge), and golf clubs having lower club numbers are called long iron-type clubs and golf clubs having higher club numbers are called short iron-type clubs. The golf clubs intermediate between the long iron-type club group and the short iron-type club group may be called middle iron-type clubs. The long iron-type clubs include club shafts having different lengths which become longer in order of decreasing club number and club heads the faces of which have different loft angles which become smaller in order of decreasing club number. Accordingly, the long iron-type clubs have a structure in which priority is given to a flying distance. On the other hand, the short iron-type clubs include club shafts having different lengths which become shorter in order of increasing club number and club heads the faces of which have different loft angles which become greater in order of increasing club number. Accordingly, the short iron-type clubs have a structure in which ball hitting control is weighted.

A conventional example of such an iron-type golf club set is proposed in Japanese Utility Model Laid-Open No. 102463/1988. In the proposed iron-type golf club set, the club heads of the long iron-type clubs of the long iron-type club group are made of a fiber-reinforced plastic material having a restitution coefficient larger than a metal material, while the club heads of the short iron-type clubs of the short iron-type club group are made of a metal material in a conventional manner. By making the long iron-type club group of the fiber-reinforced plastic material, a restitution coefficient and a friction coefficient are respectively made large and small with respect to balls, whereby the flight distance of balls become large. Further, since a ball rolls with a reduced back spin, the flying distance is extended.

However, the iron-type golf club set having the above-described arrangement has the problem that although the function of the long iron-type club group is improved, it becomes difficult to ensure continuity in shot feeling between the long iron-type club group and the short iron-type club group having the same function as a conventional one.

SUMMARY OF THE INVENTION

An object of the present invention is to provide an iron-type golf club set which is capable of improving the ball-hitting function of a long iron-type club group and of ensuring continuity in shot feeling between the long iron-type club group and a short iron-type club group.

To achieve the above object, according to the present invention, there is provided an iron-type golf club set which comprises three club groups; a long iron-type club group including a plurality of long iron-type clubs having lower club numbers, a middle iron-type club group including a plurality of middle iron-type clubs having medium club numbers, and a short iron-type club group including a plurality of short iron-type clubs having higher club numbers. The iron-type golf club set is characterized in that the long iron-type clubs of the long iron-type club group each includes a club head which contains a sole made of a metal material and a shell having a ball-hitting face and a core which is made of a foaming material and enclosed in the shell, the shell being made of a fiber-reinforced material; in that the middle iron-type clubs of the middle iron-type club group each includes a club head having a sole and an external periphery each made of a metal material and at least a ball-hitting face made of a fiber-reinforced resin; and in that the short iron-type clubs of the short iron-type club group each includes a club head made of a metal material.

In the above-described manner, the long iron-type clubs of the long iron-type club group each includes the club head having the shell which contains the ball-hitting face and the core made of the foaming material and enclosed in the shell, and the shell is made of a fiber-reinforced material, so that the flying distance of a ball can be increased. In the middle iron-type club group provided between the long iron-type club group and the short iron-type club group, at least the ball-hitting face of each of the club heads made of the metal material is made of the fiber-reinforced material so that the restitution coefficient of the club head with respect to a ball can be made smaller compared to the long iron-type club group and larger compared to the short iron-type club group. Accordingly, it is possible to improve the ball-hitting function of the long iron-type club group and it is also possible to hit balls while maintaining continuity in shot feeling between the long iron-type club group and the short iron-type club group.

DETAILED DESCRIPTION OF THE PREFERRED EMBODIMENTS

Figure 1:
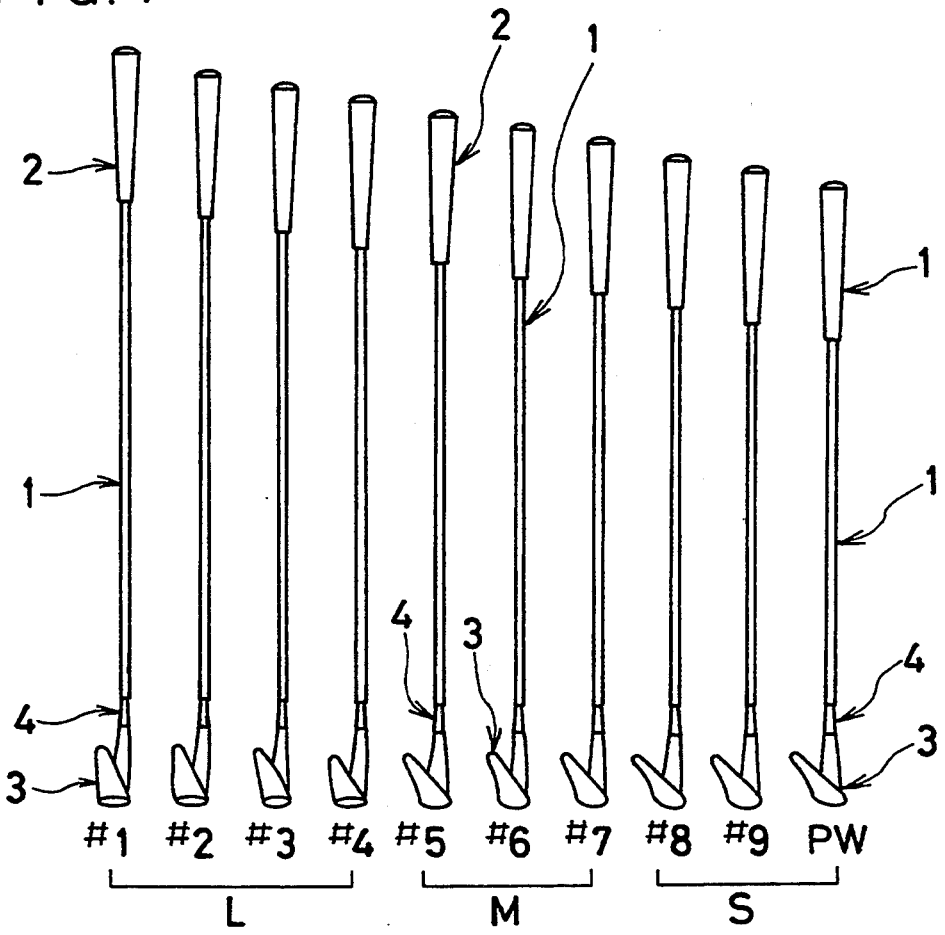
FIG. 1 is a diagrammatic, front elevational view of an iron-type golf club set according to the present invention.

As shown in FIG. 1, an iron-type golf club set includes a combination of a series of iron-type clubs numbered 1 through 9 and a PW (pitching wedge). Each of the iron-type golf clubs has a grip 2 at one end of a club shaft 1 and a club head 3 at the other end, and the club head 3 and the other end of the club shaft 1 are joined by a socket 4. The club shafts 1 have different lengths which become progressively shorter in order of increasing club number, and the ball-hitting faces of the respective club heads 3 have different loft angles which become progressively greater in order of increasing club number.

As will be described later in detail, the above-described iron-type golf club set according to the present invention comprises three club groups; a long iron-type club group L comprising a plurality of long iron-type clubs having lower club numbers (#1 through #4), a middle iron-type club group M comprising a plurality of middle iron-type clubs having medium club numbers (#5 through #7), and a short iron-type club group S comprising a plurality of short iron-type clubs having higher club numbers (#8, #9, PW).

Figure 2:
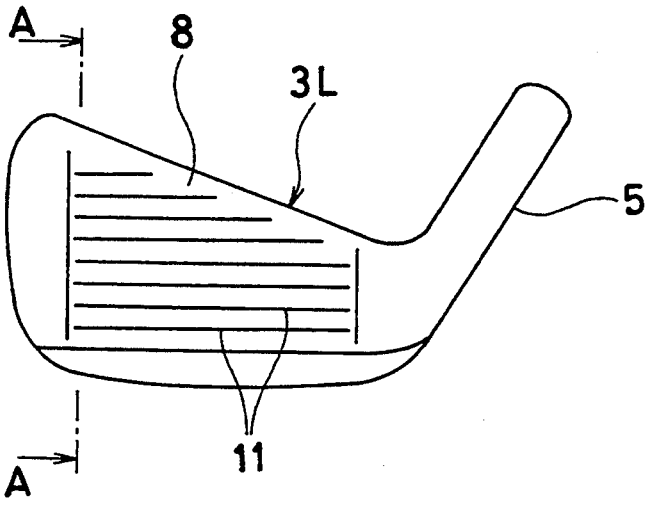
FIG. 2 is a diagrammatic, front elevational view of the club head of a long iron-type club of the long iron-type club group shown in FIG. 1.
Figure 3:
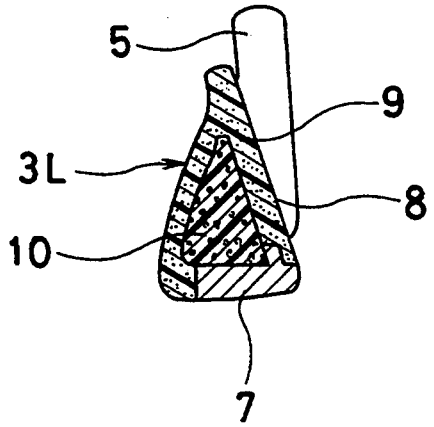
FIG. 3 is a cross sectional view taken along line A—A of FIG. 2.

In the long iron-type club group L, each of the long iron-type clubs comprises a club head 3L which, as shown in FIGS. 2 and 3, includes a hosel 5 which fixedly receives the other end of the club shaft 1, a sole 7 which continuously extends from the hosel 5 and is formed on the bottom of the club head 3L, a shell 9 which is fixed to the sole 7 and contains a ball-hitting face 8, and a core 10 enclosed into the shell 9. The ball-hitting face 8 has groove-like scoring lines 11 which extend in parallel with the Width direction of the club head 3L. The hosel 5 and the sole 7 are each made of a metal material, the shell 9 is made of a fiber-reinforced resin, and the core 10 is made of a foaming material.

Figure 4:
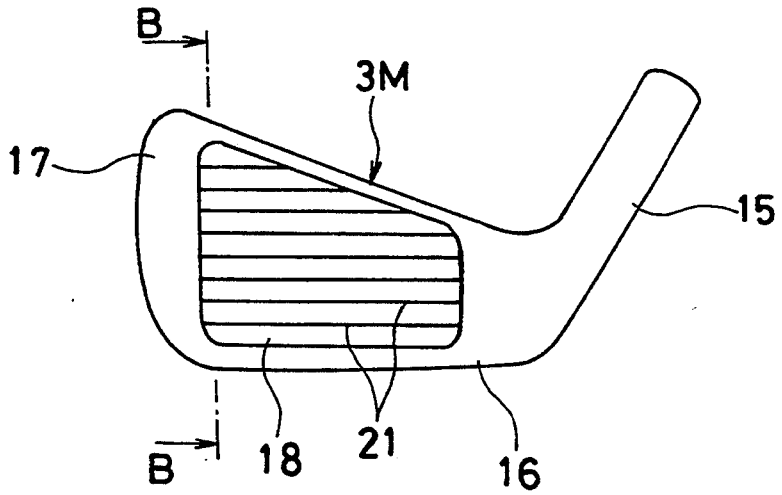
FIG. 4 is a diagrammatic, front elevational view of the club head of a middle iron-type club of the middle iron-type club group shown in FIG. 1.
Figure 5:
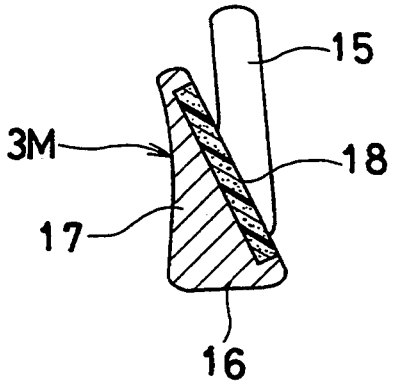
FIG. 5 is a cross sectional view taken along line B—B of FIG. 4.
Figure 6:
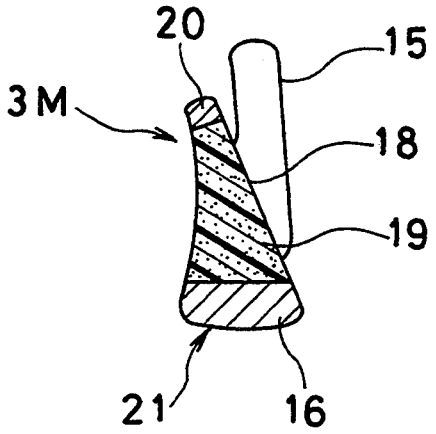
FIG. 6 is a diagrammatic, cross sectional view showing another example of the club head of the middle iron-type club of the middle iron-type club group shown in FIG. 1.

In the middle iron-type clubs of the middle iron-type club group M, each of the middle iron-type clubs comprises a club head 3M having the construction shown in FIGS. 4 and 5, and a sole 16 and an external periphery 17, both of which continuously extend from a hosel 15, are each made of a metal material and at least a ball-hitting face 18 is made of a fiber-reinforced resin. FIG. 6 shows another example of the club head 3M. In the shown example, the sole 16 and an external periphery 20 which surrounds a ball-hitting face 19 constitute an annular frame 21, and the ball-hitting face 19 is fitted in the hollow portion of the frame 21. As shown in FIG. 4, scoring lines 21 are formed on the ball-hitting face 18.

Figure 7:
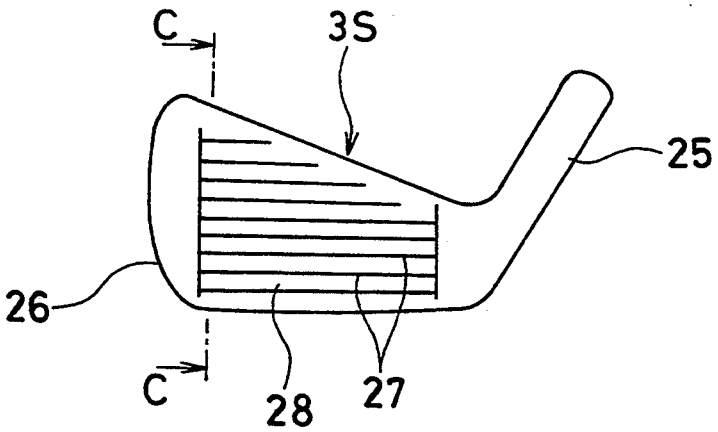
FIG. 7 is a diagrammatic, front elevational view of the club head of a short iron-type club of the short iron-type club group shown in FIG. 1.
Figure 8:
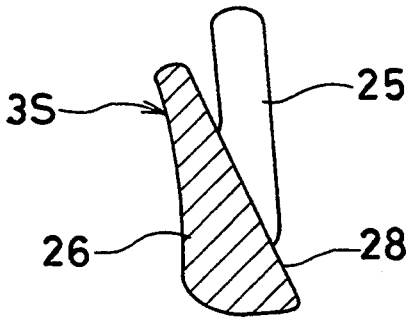
FIG. 8 is a cross sectional view taken along line C—C of FIG. 7.

In the short iron-type clubs of the short iron-type club group S, each of the short iron-type clubs comprises a club head 3S having the construction shown in FIGS. 7 and 8, and both a hosel 25 and a head body 26 having a ball-hitting face 28 on which scoring lines 27 are formed are made of only a metal material.

As described above, according to the present invention, in the club head 3L of each of the long iron-type clubs of the long iron-type club group L, the shell 9 which contains the ball-hitting face 8 and encloses the core 10 made of a foaming material is made of the fiber-reinforced material so that the flying distance of a ball can be increased. In the middle iron-type club group M intermediate between the long iron-type club group L and the short iron-type club group S, at least the ball-hitting face 18 of the club head 3M made of the metal material is made of the fiber-reinforced material so that the restitution coefficient of the club head 3M with respect to a ball can be made smaller compared to the long iron-type club group L and larger compared to the short iron-type club group S. In consequence, it is possible to improve the ball-hitting function of the long iron-type club group L and it is also possible to hit balls while maintaining continuity in shot feeling between the long iron-type club group L and the short iron-type club group S.

Figure 9:
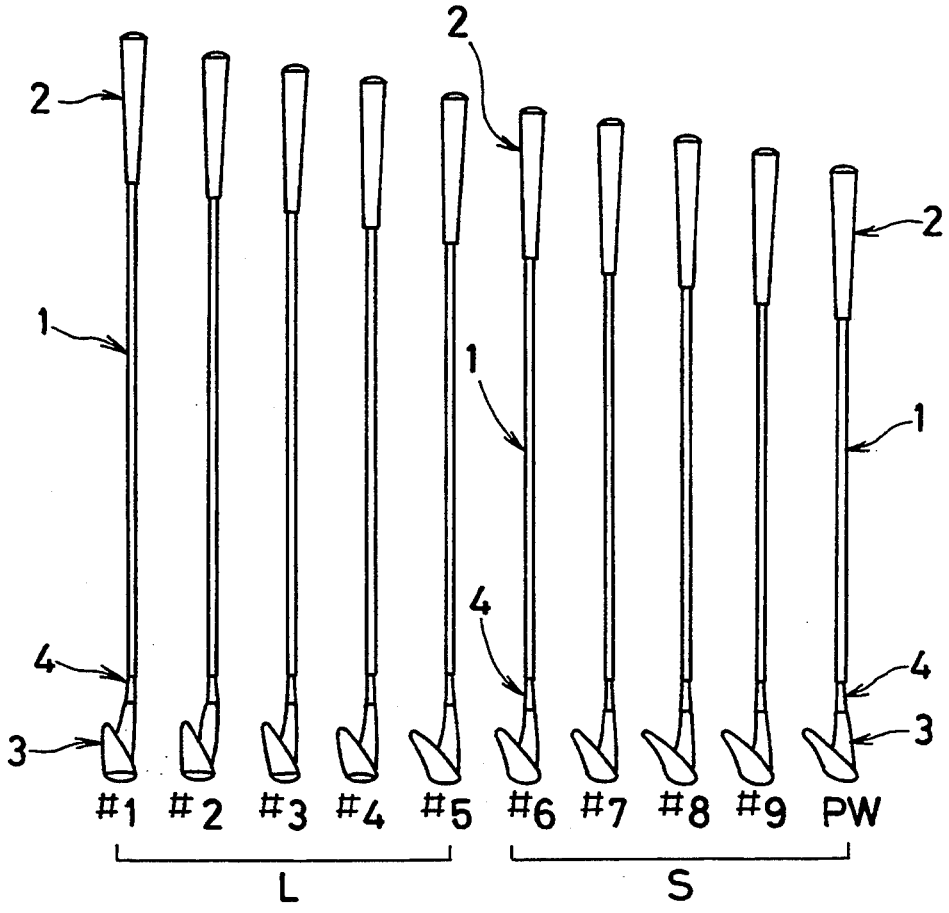
FIG. 9 is a diagrammatic, front elevational view showing another example of the iron-type golf club set according to the present invention.

FIG. 9 shows another embodiment of the iron-type golf club set according to the present invention, and the shown embodiment includes two club groups; the long iron-type club group L comprising a plurality of long iron-type clubs having lower club numbers (#1 through #5), and a short iron-type club group S comprising a plurality of short iron-type clubs having higher club numbers (#5 through #9, PW). More specifically, the club heads of the long iron-type clubs of the long iron-type club group L are each constructed as shown in FIGS. 2 and 3 which have been referred to above, and each of the club heads of the short iron-type clubs of the short iron-type club group S has a construction identical to that of the club head of the middle iron-type club of the middle iron-type club group M shown in FIGS. 4 to 6. In such combination and construction as well, it is possible to improve the ball-hitting function of the long iron-type club group L and it is also possible to ensure continuity in shot feeling between the long iron-type club group L and the short iron-type club group S.

The aforesaid fiber-reinforced resin may be selected from resins known in the art, preferably carbon fiber-reinforced resins. The foaming material is preferably selected from, but not limited to, an urethane foam or a syntactic foam. The metal material is preferably selected from soft iron or stainless steel. The club numbers assigned to each of the iron-type club groups L, M and S are not limited to any of the above-described examples, and it is also possible to alter the aforesaid assignment order of the club numbers to a small extent or overlap some of the club numbers.

As described above, according to the present invention, in the club head of each of the long iron-type clubs of the long iron-type club group, the shell which contains the ball-hitting face and encloses the core made of a foaming material is made of the fiber-reinforced material so that the flying distance of a ball can be increased. In the middle iron-type club group, at least the ball-hitting face of each of the club heads made of the metal material is made of the fiber-reinforced material so that the restitution coefficient of the club head with respect to a ball can be made smaller compared to the long iron-type club group and larger compared to the short iron-type club group. Accordingly, it is possible to realize shot feeling which continuously varies from the long iron-type club group to the short iron-type club group. Accordingly, it is possible to provide an iron-type golf club set which is capable of improving the ball-hitting function of the long iron-type club group and of ensuring continuity in shot feeling between the long iron-type club group and the short iron-type club group.

What is claimed is:

1. An iron-type golf club set comprising a plurality of consecutively numbered golf clubs, each club having a shaft and a club head having a sole and a ball-hitting face, said clubs being divided into three groups of clubs, said groups of clubs comprising a long iron-type club group including a plurality of long iron-type clubs having lower club numbers, a middle iron-type club group including a plurality of middle iron-type clubs having intermediate club numbers, and a short iron-type club group including a plurality of short iron-type clubs having higher club numbers;

each of the club heads of the long iron-type clubs of the long iron-type club group having the sole thereof made of a metal material, an outer shell portion containing the ball-hitting face made of a fiber-reinforced material and a core portion made of a foamed material enclosed within the outer shell;

each of the club heads of the middle iron-type clubs of the middle iron-type club group having the ball-hitting face thereof made of a fiber-reinforced resin with the remainder of the club head including the sole being made of a metal material; and each of the club heads of the short iron-type clubs of the short iron-type club group including the sole and the ball-hitting face thereof being made of a metal material.

2. The iron-type golf club set of claim 1, wherein the metal material of the club heads of each of the clubs of the middle iron-type club group peripherally surrounds the entire ball-hitting face of the club head.

3. An iron-type golf club set comprising a plurality of consecutively numbered golf clubs, each club having a shaft and a club head having a sole and a ball-hitting face, said clubs being divided into three groups of clubs, said groups of clubs comprising a long iron-type club group including a plurality of long iron-type clubs having lower club numbers, a middle iron-type club group including a plurality of middle iron-type clubs having intermediate club numbers, and a short iron-type club group including a plurality of short iron-type clubs having higher club numbers;

each of the club heads of the long iron-type clubs of the long iron-type club group having the sole thereof made of a metal material, an outer shell portion containing the ball-hitting face made of a fiber-reinforced material and a core portion made of a foamed material enclosed within the outer shell;

each of the club heads of the middle iron-type clubs of the middle iron-type club group having the sole and an external peripheral portion thereof made of a metal material and forming an annular frame having a hollow portion, said ball-hitting face being made of a fiber-reinforced resin and being fitted within the hollow portion of the annular frame so that the frame peripherally surrounds the entire ball-hitting face of the club head; and each of the club heads of the short iron-type clubs of the short iron-type club group including the sole and the ball-hitting face thereof being made of a metal material.

4. The iron-type golf club set of claim 3, wherein said hollow portion of the annular frame of each of the club heads of the clubs of the middle iron-type club group extends from the ball-hitting face side of the club head through to a rear side of the club head opposite from said ball-hitting face side, a fiber-reinforced core material being fitted within said hollow portion, one side of which forms said ball-hitting face of the club head.

5. An iron-type golf club set comprising a plurality of consecutively numbered golf clubs, each club having a shaft and a club head having a sole and a ball-hitting face, said clubs being divided into two groups of clubs, said groups of clubs comprising a long iron-type club group including a plurality of long iron-type clubs having lower club numbers and a short iron-type club group including a plurality of short iron-type clubs having higher club numbers;

each of the club heads of the long iron-type clubs of the long iron-type club group having the sole thereof made of a metal material, an outer shell portion containing the ball-hitting face made of a fiber-reinforced material and a core portion made of a foamed material enclosed within the outer shell; and each of the club heads of the short iron-type clubs of the short iron-type club group having the ball-hitting face thereof made of a fiber-reinforced resin with the remainder of the club head including the sole being made of a metal material.

6. The iron-type golf club set of claim 5, wherein the metal material of the club heads of each of the clubs of the short iron-type club group peripherally surrounds the entire ball-hitting face of the club head.

7. An iron-type golf club set comprising a plurality of consecutively numbered golf clubs, each club having a shaft and a club head having a sole and a ball-hitting face, said clubs being divided into two groups of clubs, said groups of clubs comprising a long iron-type club group including a plurality of long iron-type clubs having lower club numbers and a short iron-type club group including a plurality of short iron-type clubs having higher club numbers;

each of the club heads of the long iron-type clubs of the long iron-type club group having the sole thereof made of a metal material and an outer shell portion containing the ball-hitting face made of a fiber-reinforced material and a core portion made of a foamed material enclosed within the outer shell; and each of the club heads of the short iron-type clubs of the short iron-type club group having the sole and an external peripheral portion thereof made of a metal material and forming an annular frame having a hollow portion, said ball-hitting face being made of a fiber-reinforced resin and being fitted within the hollow portion of the annular frame so that the frame peripherally surrounds the entire ball-hitting face of the club head.

8. The iron-type golf club set of claim 7, wherein said hollow portion of the annular frame of each of the club heads of clubs of the short iron-type club group extends from the ball-hitting face side of the club head through to a rear side of the club head opposite from said ball-hitting face side, a fiber-reinforced core material being fitted within said hollow portion, one side of which forms said ball-hitting face of the club head.

* * * * *